US006089208A

United States Patent [19]

Kowatari et al.

[11] Patent Number: 6,089,208

[45] Date of Patent: Jul. 18, 2000

[54] THROTTLE VALVE OPENING AND CLOSING APPARATUS FOR A VEHICLE, AND VEHICLE INTERNAL COMBUSTION ENGINE USING THE APPARATUS

[75] Inventors: Takehiko Kowatari, Kashiwa; Shigeru Tokumoto, Hitachinaka; Kousaku Ohno, Chiyoda-machi, all of Japan

[73] Assignee: Hitachi, Ltd., Tokyo, Japan

[21] Appl. No.: 09/157,151

[22] Filed: Sep. 18, 1998

[30] Foreign Application Priority Data

Sep. 19, 1997 [JP] Japan ..... 9-254691

[51] Int. Cl.[7] ..... F02D 9/00

[52] U.S. Cl. ..... 123/396; 123/399

[58] Field of Search ..... 123/395–400, 123/376, 377, 198 D; 251/129.02, 129.11, 129.12

[56] References Cited

U.S. PATENT DOCUMENTS 4,392,502 7/1983 Weston ..... 123/342
5,014,666 5/1991 Westenberger ..... 123/339
5,161,504 11/1992 Guest, Jr. et al. ..... 123/361
5,367,997 11/1994 Kawamura et al. ..... 123/399
5,562,081 10/1996 Hitchcook ..... 123/399
5,787,861 8/1998 Suzuki et al. ..... 123/396
5,983,858 11/1999 Hashimoto et al. ..... 123/396

*Primary Examiner*—Henry C. Yuen
*Assistant Examiner*—Arnold Castro
*Attorney, Agent, or Firm*—Antonelli, Terry, Stout & Kraus, LLP

[57] ABSTRACT

When the power source of a motor is turned off, a cam connected to the motor is held at an initial default stopping position by a return spring generating a torque in one direction and a throttle valve connected to a cam via an arm, and a valve gear is held at a corresponding default opening position. When the motor rotates and generates its torque, the arm first closes the throttle valve to a prescribed minimum opening and then opens the throttle valve in the fully open direction.

14 Claims, 10 Drawing Sheets

THROTTLE VALVE OPENING AND CLOSING APPARATUS FOR A VEHICLE, AND VEHICLE INTERNAL COMBUSTION ENGINE USING THE APPARATUS

BACKGROUND OF THE INVENTION

The present invention relates to an apparatus for controlling the opening and closing operations of a throttle valve, which is used for controlling the amount of intake air taken into an internal combustion engine, and to a vehicle internal combustion engine using the apparatus.

The output power of a vehicle engine is usually controlled by opening and closing a throttle valve which is responsive to movements of an acceleration pedal operated by a driver. The throttle valve is placed in an air intake path of the engine and is used for controlling the output power of the engine by adjusting the amount of intake air.

A throttle valve opening and closing apparatus is disclosed in JP-A-150449/1988. This apparatus includes a control unit for determining the opening degree of a throttle valve in response to a command value for a desired amount of acceleration, a motor for driving the throttle valve to set its opening degree to a value between a fully closed position and a fully opened position, a return spring for pushing the throttle valve in the valve closing direction, and an elastic member for pulling the throttle valve in the valve opening direction.

The valve pushing force of the return spring is set to be lower than the valve pulling force of the elastic member, and the motor driving force to close the throttle valve is set to be smaller than the valve pulling force of the elastic member. Thus, when the motor does not drive the throttle valve, the throttle valve is pushed by the return spring in the closing direction, and the position of the throttle valve is automatically adjusted to an equilibrium position established by the pushing force of the return spring and the pulling force of the elastic member. In this way, an opening degree at an adjusted position of the throttle valve is predetermined so as to secure a minimal amount of intake air sufficient to start the engine at a low temperature, and to make it possible to drive the vehicle, even if the driving force of the motor can not be generated.

Furthermore, a throttle valve opening and closing apparatus for adjusting the rotation speed during idling operation of an internal combustion engine is disclosed in U.S. Pat. No. 4,991,552. In this apparatus, a first lever mechanism and a second lever mechanism are provided, and a driving force is applied to the shaft of a throttle valve in the opening direction.

The first lever mechanism is driven by an electrical motor or an air actuator and is used for adjusting the rotation speed during idling operation. Thus, the first lever mechanism is composed so as to cause the throttle valve to open by about 25 deg. from the fully closed position. Conversely, the second lever mechanism opens and closes the throttle valve in response to en acceleration pedal operation performed by a driver, and the operation performed by the first lever mechanism takes priority over the valve opening operation performed by the second lever mechanism.

Moreover, the first and second lever mechanisms apply a force to the throttle valve only in the opening direction, and the force in the closing direction is applied by a return spring.

In a present day vehicle, the target output power is generated by controlling the opening of the throttle valve to a position between a fully closed state and a fully open state. For emitting a cleaner exhaust gas and for other reasons, it is desirable to finely control the air to fuel ratio. Especially in a direct injection engine, fine control of the air to fuel ratio is desired so as to be able to use stratified combustion and uniform combustion properly and effectively. Therefore, it is necessary to control the opening of the throttle valve so as to follow the command value accurately between the fully closed and fully open states.

Furthermore, it is preferable to provide a redundant means for closing the throttle valve. By providing a redundant means, even if one of the means becomes inoperable, it is possible to quickly close the throttle valve to a predetermined position (hereafter referred to as the default position) to prevent the vehicle from running away.

In the first of the two above-mentioned conventional techniques for holding the state in which the throttle valve is slightly open at the default position, a valve pushing means and a valve pulling means for applying forces in opposite directions, that is, a return spring and an elastic member, are provided. Although it is comparatively easy to control the opening degree of the throttle valve so as to follow the command value if only one of the two above means is operated, when the other means begins to become effective, the control unit can not control the throttle valve so as to follow the output power command value quickly in response to changes in the force generated by the two means, and so the delay in responding to the command becomes large. Thus, the accuracy and response time in the control of the output power is degraded.

On the other hand, in the throttle valve opening and closing apparatus disclosed in the second one of the above-mentioned conventional techniques, the control over the opening of the throttle valve does not deal with running operations of the vehicle, but concerns only the idling operation of the engine. In this apparatus for adjusting the engine rotation speed during idling, the valve pushing force is applied to the throttle valve by one return spring, and the control unit holds the position of the throttle valve at the default position so that it is slightly open. However, since this control unit is provided to adjust the rotation speed during idling, it controls the throttle valve only in the range from the fully closed state to 25 deg. If the throttle valve is controlled in the range from the fully closed state to the fully open state (90 deg.) by using this apparatus, which has been designed for adjusting the rotation speed during idling, because of the restriction due to the oscillation range of the lever mechanisms, it is inevitable that the size of the lever mechanism will become larger, and so it will be impractical to use this apparatus in a vehicle.

Moreover, if the valve closing operation is carried out by using only the return spring, as in the latter apparatus, there is the possibility that it will become impossible to close the throttle valve if the return spring becomes broken. Furthermore, if a quick closing operation of the throttle valve is needed, since the throttle valve is driven by only the return spring, the response time is large, and the throttle valve cannot possibly be closed within the necessary time (see FIG. 11). If a large return spring force is used, the load force needed in opening the throttle valve increases, and the valve opening operation is delayed. To solve this problem of the delay in the valve opening operation, it is necessary to increase the size of the throttle valve driving means (if a motor is used, the size of the motor would need to be increased).

SUMMARY OF THE INVENTION

An object of the present invention is to provide a mechanism which is able to hold the position of a throttle valve in a slightly open state without application of a valve driving force and to control the opening of the throttle valve so as to follow a command value for the opening of the throttle valve with a minimal delay, in a throttle valve opening and closing apparatus for an internal combustion engine to be employed in a vehicle, by operating a drive means for controlling the opening of the throttle valve in a range from a fully closed state to a fully open state, or from a fully open state to a fully closed state.

The first feature of the present invention designed to attain the above object is to provide a throttle valve opening and closing apparatus which adjusts the amount of intake air input into an internal combustion engine in the range from a fully open throttle valve state to a fully closed throttle valve state, including drive means for driving the throttle valve, and control means for controlling the opening degree of the throttle valve so as to follow a command value for the opening of the throttle valve, wherein the throttle valve is held in a state in which the throttle valve is opened to a predetermined opening degree in an initial state without the application of a drive force by the drive means to the throttle valve, and the throttle valve is driven at first so as to close to a prescribed minimal opening, and then begin to open, when the throttle valve is driven from the initial state.

The second feature of the present invention designed to attain the above object is to provide a throttle valve opening and closing apparatus which adjusts the amount of intake air input into an internal combustion engine in a range from a fully open state to a fully closed state, including drive means for driving the throttle valve, and control means for controlling the opening degree of the throttle valve so as to follow a command value for the opening of the throttle valve, wherein the drive means comprises valve opening change prescribing means and operation means for operating the valve opening change prescribing means, and the valve opening change prescribing means holds the throttle valve in a state in which the throttle valve is opened by a predetermined amount in the initial state when the drive force of the operation means does not act on the valve opening change prescribing means, and drives the throttle valve so as to first close to a prescribed minimal opening, and then to begin to open, when the throttle valve is driven from the initial state.

The third feature of the present invention designed to attain the above object is that the above-described throttle valve opening and closing apparatus further includes force applying a means for applying force to the throttle valve in the closing direction of the throttle valve so that the throttle valve is held at a state in which the throttle valve is opened to a predetermined opening degree in the initial state without the application of a drive force by the drive means to the throttle valve.

The fourth feature of the present invention designed to attain the above object is that, in the above-described throttle valve opening and closing apparatus, the operation means in the drive means is a motor, and the valve opening change prescribing means changes the opening degree of the throttle valve from a predetermined opening degree to a fully open state via the prescribed minimal opening degree while the motor rotates substantially by more than 180 deg.

In the above-mentioned apparatus, since the opening degree of the throttle valve changes from a predetermined opening degree to a fully open position while the motor rotates substantially by more than 180 deg., the size of the motor can be decreased.

The fifth feature of the present invention designed to attain the above object is that, in the above-described throttle valve opening and closing apparatus, the shaft of the motor is arranged parallel to that of the throttle valve shaft, and the valve opening change prescribing means comprises a rotary element connected to the shaft of the motor, a transmission element connected to the rotary element, and a valve drive element connected to the transmission element and the shaft of the throttle valve, wherein a differential value with respect to the rotation angle of the motor, of the distance between the motor shaft and the end of the transmission element, on the side of the throttle valve, changes its sign once in the rotation range of the motor.

The sixth feature of the present invention designed to attain the above object is that, in the above-described throttle valve opening and closing apparatus, the rotary element is a cam having a guide part for converting the rotation angle of the motor to an opening of the throttle valve, and an arm engaged with the guide part and connected to the shaft of the throttle valve, wherein a differential value, with respect to the rotation angle of the motor, of the distance between the motor shaft and the guide part is positive in one region and negative in another region in the rotation range of the motor.

The seventh feature of the present invention designed to attain the above object is that, in the above-described throttle valve opening and closing apparatus, the rotary element, the valve drive element, and the transmission element, are a crank driven by the motor, a crank for rotating the shaft of the throttle valve, and a link connected between the two cranks, respectively, and the force applying means is a spring for applying a force to the shaft of the crank driven by the motor in one direction.

The eighth feature of the present invention designed to attain the above object is that, in the above-described throttle valve opening and closing apparatus, the connection point of the shaft of the motor and the crank acting as the rotary element, the connection point of the crank acting as the rotary element and the link, and the connection point of the link and the crank acting as the valve drive element, are aligned substantially in a row when the throttle valve is at the position of the prescribed minimal opening.

The ninth feature of the present invention designed to attain the above object is to provide a vehicle internal combustion engine comprising:

a plurality of cylinders, a fuel system for feeding fuel into each of the plurality of cylinders, and a throttle valve opening and closing apparatus which adjusts the amount of intake air input into an internal combustion engine by controlling the throttle valve in the range from a fully open state to a fully closed state, including drive means for driving the throttle valve and control means for controlling the opening degree of the throttle valve so as to follow a command value for a desired opening degree of the throttle valve, wherein the drive means comprises valve opening change prescribing means and operation means for operating the valve opening change prescribing means, and the valve opening change prescribing means holds the throttle valve in a state in which the throttle valve is opened to a predetermined opening degree in an initial state without the application of a drive force by the operation means on the valve opening change prescribing means, and the valve opening change prescribing means for also drives the throttle valve at first to close to a prescribed minimal opening and then to begin to open, when the throttle valve is driven from its initial state.

DETAILED DESCRIPTION OF THE EMBODIMENTS

Hereinafter, various embodiments of the present invention will be explained in detail with reference to the drawings.

Figure 1A:
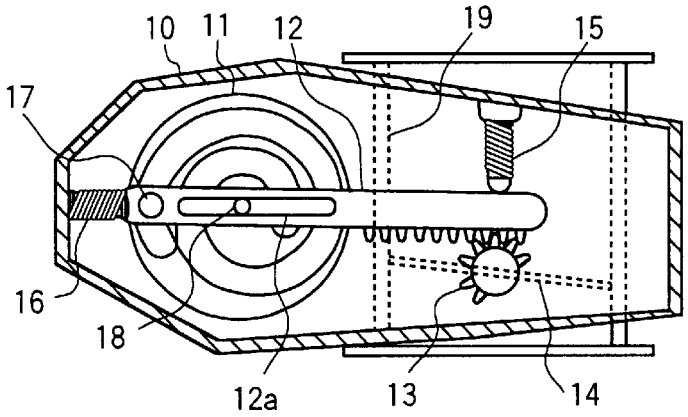
FIGS. 1A, 1B and 1C are diagrams which show the composition of a throttle valve opening and closing apparatus representing a first embodiment according to the present invention.
Figure 1B:
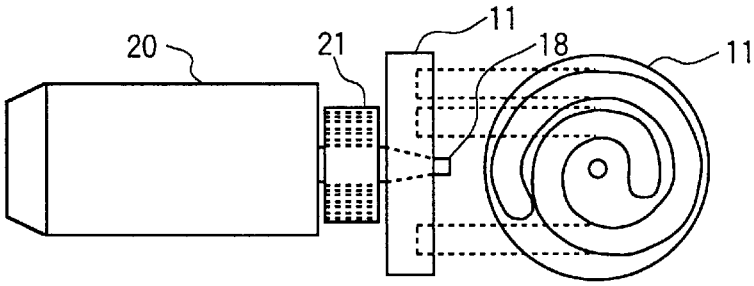
Figure 1C:
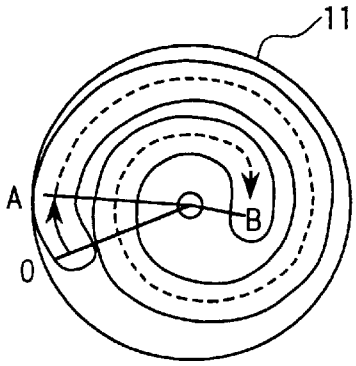
Figure 2A:
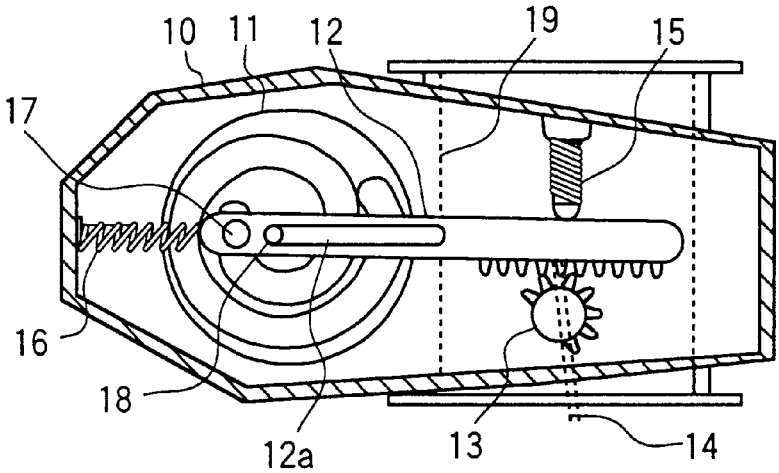
FIGS. 2A and 2B are diagrams which show operation states of the throttle valve in the first embodiment.
Figure 2B:
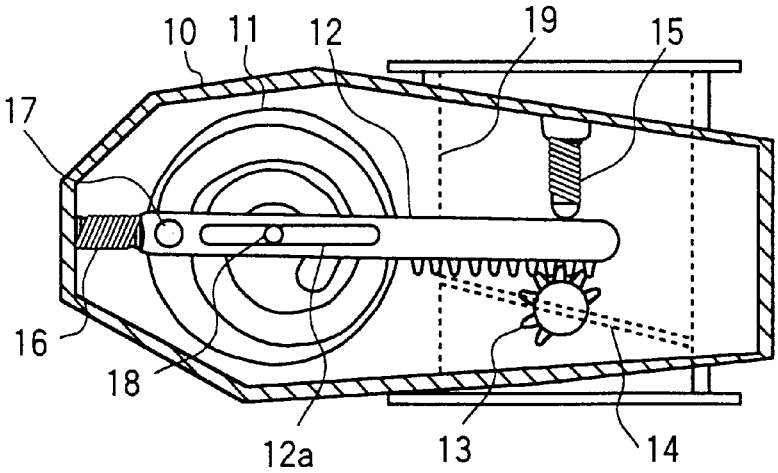

FIG. 1A is an elevated view showing the composition of a throttle valve opening and closing apparatus representing a first embodiment of this invention, and FIG. 1B is a side view showing the arrangement of a motor, a return spring, and a cam in this apparatus, in which an elevated view of the cam is also shown. Moreover, FIG. 1C shows an example of the structure of the cam. Furthermore, FIG. 2A shows a state in which the position of the throttle valve is fully open, and FIG. 2B shows a state in which the throttle valve is held at the initial stopping position.

In this embodiment, the motor 20, the cam 11, an arm 12, and a valve gear 13, are used as a drive means to drive the throttle valve 14 from the fully closed position to the fully open position. The cam 11, the arm 12, and the valve gear 13 compose a transmission mechanism for transmitting the rotation force of the motor 20 to the shaft of the throttle valve 14. More specially, the cam 11 can be regarded as a rotary element connected to the shaft of the motor 20, the valve gear 13 can be regarded as a valve drive element connected to the shaft of the throttle valve, and the arm 12 can be regarded as a transmission element for transmitting the drive force of the rotary element to the valve drive element.

The detailed composition of this throttle valve opening and closing apparatus will be explained below.

The cam 11, in which a spiral groove is formed, is fixed to the shaft of the motor 20 and a coiled return spring 21, used as a force applying means to apply force to the cam 22 in the direction for driving the throttle valve from the fully open position to the fully closed position, is connected between the cam 20 and the casing 10. A follower 17, which is fixed to the arm 12, is engaged to slide in the groove of the cam 11. The follower 17 is pushed to the inner side wall (cam surface) of the groove by a force generated by a spring 16 in a direction toward the center of the cam 11. In the arm 12, a long hole or slot 12*a* is formed, and a part 18 projecting from the motor shaft is inserted into the long hole 12*a*. In the other end of the arm 12, teeth are arranged in a row (in a rack manner), and the teeth are engaged with the valve gear 13, which is fixed on the valve shaft. To secure the engagement of the teeth with the valve gear 13, the arm 12 is pushed against the valve gear 13 by a spring 15. Thus, the arm 12 is restricted to longitudinal movements by the projecting part 18, the valve gear 3 and the spring 15. The throttle valve 14 and the valve gear 13 are coaxially connected to each other.

When the cam 11 is rotated by the motor 20, the arm 12 fixed to the follower 17 moves longitudinally, and the throttle valve 14 is rotated via the valve gear 13. In this way, an air intake path 19 to the engine is opened or closed by the rotated throttle valve 14.

The arrangement of the cam 11 and the motor 20 is shown in FIG. 1B. One terminal end of the return spring 21 is fixed to the casing 10, and the return spring is coiled to generate a spring force in a clockwise direction, as seen in FIG. 1A. The torque of the return spring 21 increases in a linear manner in proportion to an increase in the rotation angle of the motor 20.

When the motor 20 generates a torque greater than that of the return spring 21, the cam 11 begins to rotate (in the counter-clockwise direction in FIG. 1A), and the follower 17 is moved progressively towards the rotation center of the motor (to the right in FIG. 1A). Consequently, the arm 12 is translated longitudinally to the right and operates to open the throttle valve 14. To close the throttle valve, the cam 11 is rotated by the motor in the reverse direction. Thus, since the follower 17 moves away from the center of the cam 11, the arm 12 is translated longitudinally to the left and the throttle valve is rotated in the closing direction. That is, if the follower 17 moves toward the center of the cam 11, the throttle valve 14 is opened, and vice versa. If a quick closing of the throttle valve 14 is not required, the valve 14 can be closed by rotating the cam 11 with application of a motor torque less than that of the return spring 21 in the direction opposite to that of the opening direction.

An elevated view for illustrating the structure of the cam 11 is shown in FIG. 1C. The angle of the cam surface in the cam 11 is defined as 0 deg. at the end of the groove located in the outer section of the cam 11. The groove is directed in the outward direction from this end until the cam surface reaches the angle A, so that the distance between the center of the cam 11 and the cam surface of the groove increases. Moreover, the groove is formed in a spiral shape from the angle A to the angle B so that the distance between the center of the cam 11 and the cam surface of the groove progressively decreases. That is, if the distance between the center of the cam 11 and the cam surface of the groove is differentiated with respect to the rotation angle of the cam 11, the sign of the differential value is positive between the angle of 0 deg. and the angle A, and it is negative between the angle A and the angle B. The position of the throttle valve 14 is almost fully closed when the follower is at the angle A. To open the throttle valve fully at the angle B, the difference between the distance from the cam surface of the groove to the center of the cam 11 at the angle A and that at the angle B is set to equal the product of the diameter of the valve gear 13 and the operation angle of the throttle valve 14 (in units of [rad]). Similarly, the distance between the cam surface of the groove and the center of the cam 11 at the angle of 0 deg. is set to equal the product of the diameter of the valve gear 13 and a predetermined default angle.

The distance between the follower 17 and the shaft of the throttle valve 14 increases in the interval between the angle of 0 deg. and the angle A, and decreases in the interval between the angle A and the angle B. Therefore, if this distance is differentiated with respect to the rotation angle of the motor 20, the sign of the differential value is positive in the beginning of the rotation, and is reversed to negative after the angle A is exceeded.

FIG. 1A shows a state in which the throttle valve 14 is fully closed, and FIG. 2A shows a state in which the throttle valve 14 is fully opened by the torque generated by the motor 20. Moreover, FIG. 2B shows that the cam 11 is returned to the default position by the return spring 21 when the power source of the motor 20 is turned off.

Figure 3:
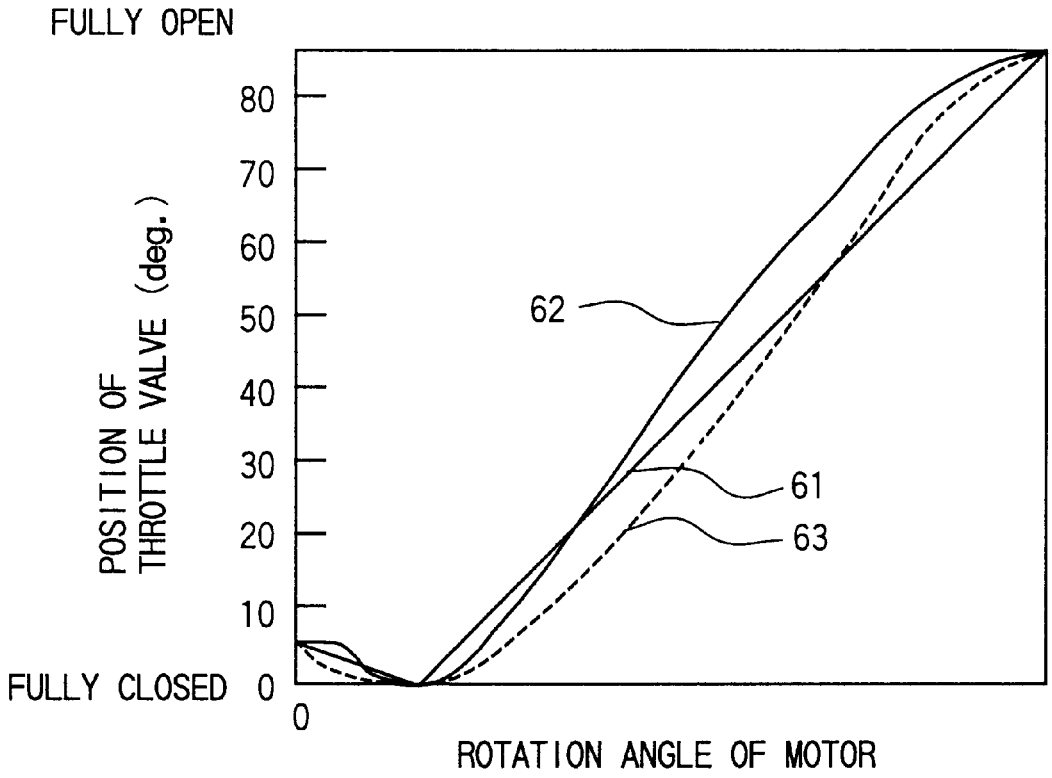
FIG. 3 is a graph showing the relation between the position of the throttle valve and the rotation angle of the motor.

In FIG. 3, the curve 61 indicates the relationship between the rotation angle of the motor 20 and the opening of the throttle valve 14. When the rotation angle of the motor 20 and the cam 11 is 0 deg., the position of the throttle valve 14 is the default position. Moreover, as the cam rotates toward the opening direction, the throttle valve 14 is at first almost fully closed, and then is progressively opened until it is fully open as the rotation angle increases. In the ordinary operation of a vehicle, the throttle valve 14 is operated in the range from the fully closed position (cam angle A) to the fully open position (cam angle B). On the other hand, in the idling operation of a vehicle, the throttle valve 14 is operated at near full closure (cam angle 0°).

If the groove of the cam 11 is formed as an involute curve, linear valve opening characteristics can be obtained, as shown by the curve 61 in FIG. 3. In accordance with the linear characteristics of the curve 61, the throttle valve 14 becomes easily controlled.

Figure 4:
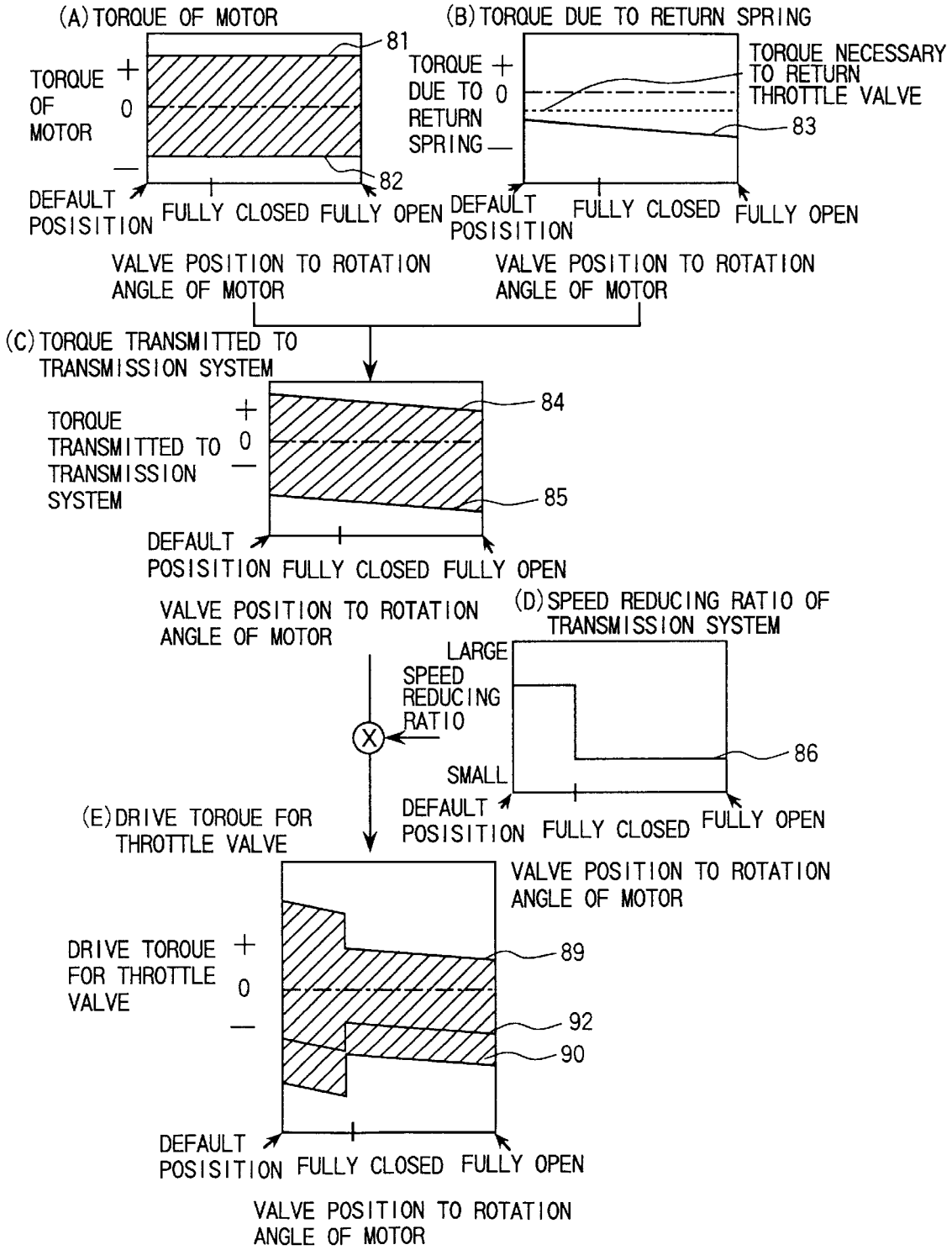
FIG. 4 is a flow diagram explaining an example of a torque transmission system of the present invention.

In the diagrams (A) to (E) in FIG. 4, the flow of the torque transmission is shown, in which the torque generated by the motor 20 in the throttle valve opening and closing apparatus of this embodiment is combined with the torque of the return spring 21, the combined torque is subjected to a speed reducing operation in the transmission system, and the resultant torque is then transmitted to the throttle valve 14. The sign of the torque in the direction from the fully closed position to the fully open position of the throttle valve and that of the torque in the reverse direction are expressed by (+) and (−), respectively. In the following, the flow of the torque transmission will be explained in detail.

The diagram (A) shows the relationship between the torque generated by the motor 20 and the position of the throttle valve 14 corresponding to the rotation angle of the motor 20. The torque generated by the motor 20 is constant independent of the rotation angle of the motor 20. Also, the motor 20 can generate torque at any level between the maximum possible torque in the (+) direction (line 81) and the maximum possible torque in the (−) direction (line 82).

Moreover, the line 83 in the diagram (B) shows the relationship between the torque from the return spring 21 and the position of the throttle valve 14 corresponding to the rotation angle of the motor 20.

The return spring 21 generates a larger torque than that necessary to return the throttle valve 14 to the initial position (default position). The torque from the return spring 21 always acts on the cam 11 in the (−) direction, and increases in proportion to the rotation angle of the motor 20.

Moreover, the diagram (C) shows the torque transmitted to the transmission system. Since the return spring 21 is connected to the motor 20, the torque transmitted to the transmission system is equal to the combined torque of the torque generated by the motor 20 and that generated by the return spring 21. In the rotation of the motor 20 in the (+) direction, since the torque from the return spring 21 increases in proportion to the rotation angle of the motor 20, the combined torque decreases as the rotation angle increases (line 84). On the other hand, in the rotation of the motor 20 in the (−) direction, since the direction of the torque from the return spring 21 is the same as that generated by the motor 20, the absolute value of the combined torque increases as the rotation angle increases (line 85).

Moreover, the diagram (D) shows the speed reducing ratio in the transmission system. In this embodiment, in the range from the default position, that is, the angle 0 deg. position of the motor 20, to the fully closed position of the throttle valve 14, the speed reducing ratio is set as a large value, and it is set as a small value in the range of the rotation angle larger than that set at the fully closed position, as shown by the line 86. The torque transmitted to the transmission system is increased by the speed reducing ratio and is applied to the throttle valve 14. The torque applied to the throttle valve 14 is proportional to the speed reducing ratio.

Furthermore, the diagram (E) shows the torque transmitted from the transmission system to the throttle valve 14. In accordance with the speed reducing ratio shown by the line 86, as shown by the lines 89 and 90, the torque transmitted to the throttle valve 14 is large, in the range from the rotation angle 0 deg. to the rotation angle at the fully closed position of the throttle valve 14, in both the (+) and (−) directions, and is small after the rotation angle proceeds past the fully closed position during opening of the throttle valve. The transmitted torque is applied to the throttle valve 14 in the (+) or (−) direction, and it drives the throttle valve 14.

Figure 11:
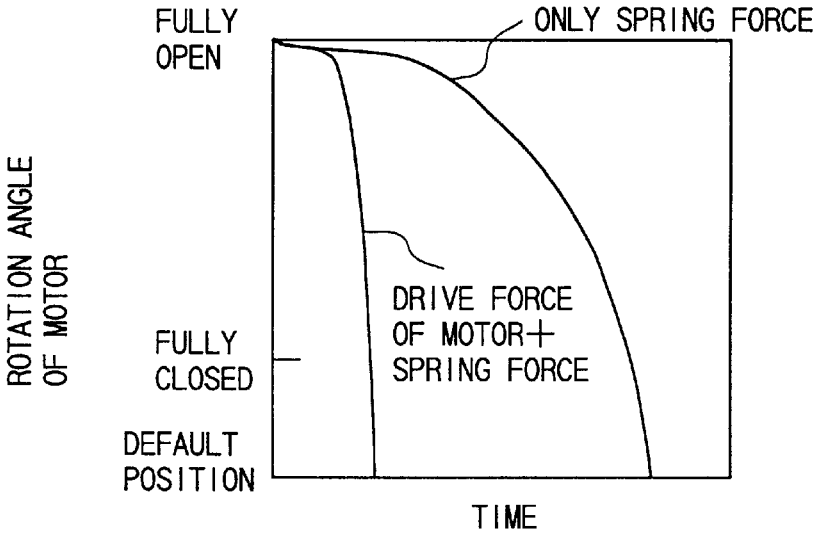
FIG. 11 is a graph showing the time response of the valve position when the throttle valve is driven from the fully open position to the default opening.

If the motor 20 does not generate torque in the closing direction, the torque applied to the throttle valve 14 will consist only of the torque from the return spring 21, as shown by the graph 92. Since this torque is smaller than the combined torque of the torque generated by the motor 20 and that from the return spring 21 (line 90), the return time of the throttle valve 14 is increased. However, this torque is large enough to return the throttle valve 14 to the default position. For example, in FIG. 11, when only the torque from the return spring 21 is applied to the throttle valve 14, changes in time as to the valve position from the fully open position to the default position are shown in comparison with that when the combined torque of the torque generated by the motor 20 and that from the return spring 21 is applied to the throttle valve.

Although an involute spiral curve is employed for the groove in the cam 11 in this embodiment, the nonlinear characteristics indicated by the curve 62 shown in FIG. 3 also can be realized by using another spiral curve. This spiral curve can be determined based on the characteristics of the curve 62. If the cam has a groove formed by using a curve based on the characteristics of the curve 62, the flow of the torque transmission will be as shown in the diagrams (A) to (E) in FIG. 5, similar to FIG. 4. If the nonlinear valve opening characteristics shown by the curve 63 are used, it is possible to set the speed reducing ratio to be continuously variable. For example, as shown by the line 87 in the diagram (D), the speed reducing ratio is set such that the ratio increases in the range of the rotation angle of 0 deg. of the motor 20 to the rotation angle at the fully closed position, and it reaches a maximum value at the rotation angle corresponding to the fully closed position. As the motor 20 rotates further, the speed reducing ratio decreases and then increases again.

Figure 5:
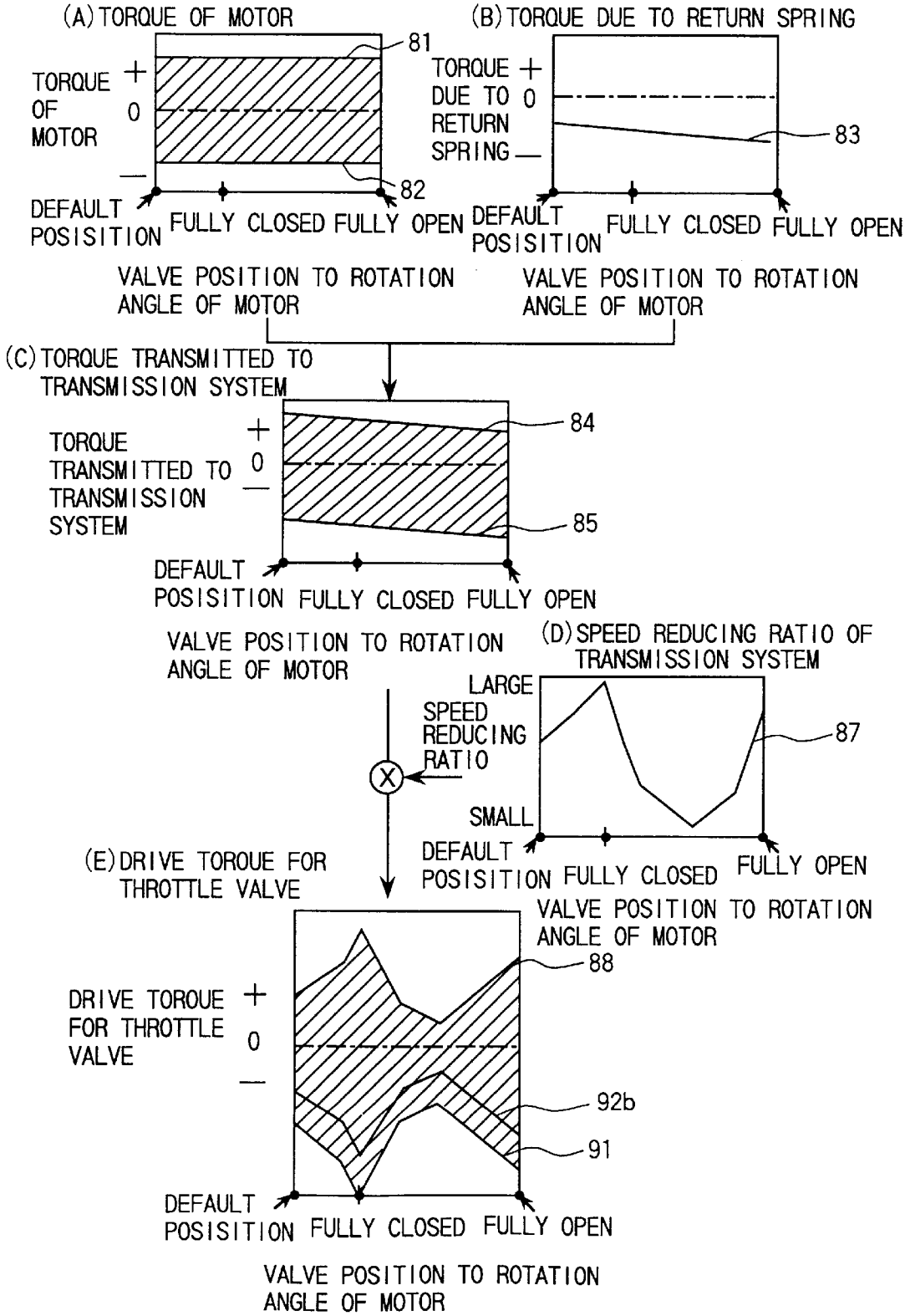
FIG. 5 is a flow diagram explaining another example of a torque transmission system of the present invention.

If the speed reducing ratio is set to be continuously variable as shown by the line 87, the drive torque increases in the range from the rotation angle of 0 deg. of the motor 20 to the rotation angle at the fully closed position, and it reaches its maximum value at the rotation angle corresponding to the fully closed position; and, after the rotation angle of the motor corresponding to the fully closed position is reached, the speed reducing ratio decreases and increases again, as shown by the lines 88 and 91 of the diagram (E) in FIG. 5. Using the nonlinear valve opening characteristics brings an advantage in that, since a large torque applied to the throttle valve 14 can be generated at the rotation angle of the motor 20 corresponding to the fully open position, it is possible to reduce the torque to be generated by the motor 20, which is necessary to hold the fully open position.

In this embodiment, the throttle valve 14 is closed and pushed in the direction of the default position by the return spring 21. Although it is possible to hold the throttle valve 14 at the default position using only the force of the return spring 21, the throttle valve 14 also can be returned to the default position by using only the motor 20. Thus, even if the return spring 21 or the motor 20 does not function, the throttle valve 14 still can be returned to the default position. That is, it is possible to design the closing means of the throttle valve as a redundant system.

Furthermore, by forming the groove in the cam 11 in a spiral shape, the cam 11 can be rotated by substantially more than 180 deg. in one direction, whereby the throttle valve 14 can be opened from the default position to the fully open position via the almost fully closed state in response to an comparatively small torque of the motor 20. Thus, the throttle valve opening and closing apparatus can be downsized.

Figure 6A:
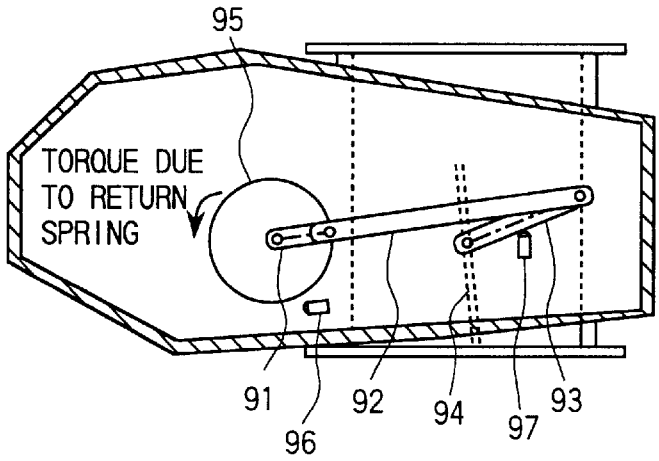
FIGS. 6A, 6B and 6C are diagrams which show the composition of the throttle valve opening and closing apparatus representing a second embodiment according to the present invention and the operation states of this apparatus.
Figure 6B:
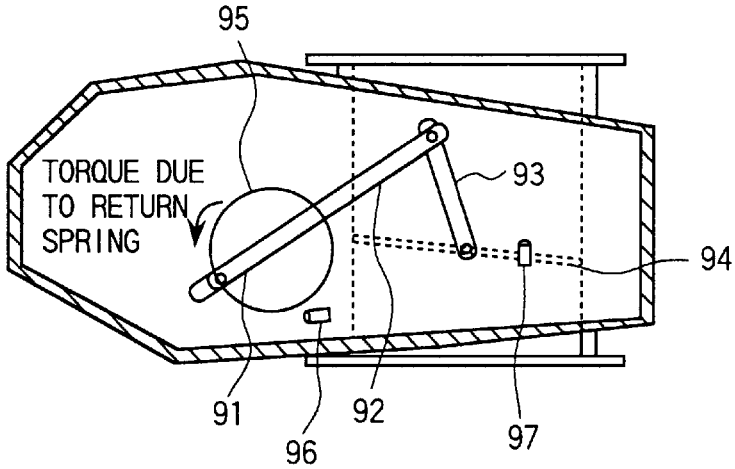
Figure 6C:
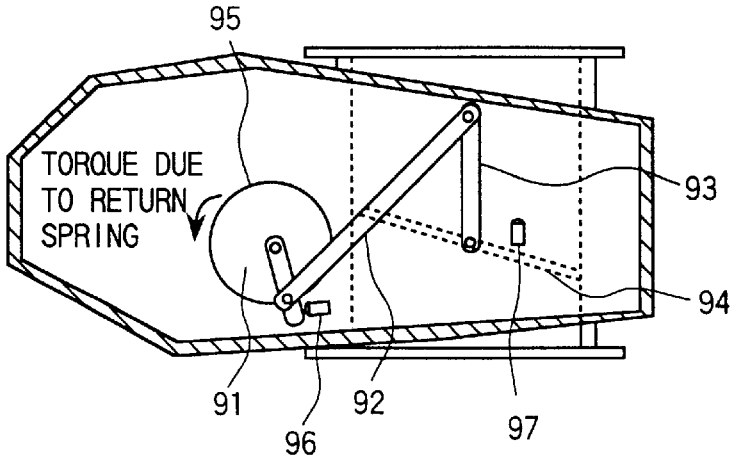

In the following, a second embodiment of the invention will be explained with reference to FIGS. 6A, 6B, and 6C.

A feature of this embodiment is that the throttle valve opening and closing apparatus is formed as simply as possible in order to realize a low production cost. To attain the above feature, the drive means for operating the throttle valve 94 from the fully closed position to the fully open position and vice versa is composed of a motor 95, a crank 91, a crank 93, and a link 92. The cranks 91 and 93 and the link 92 form a transmission mechanism for transmitting the rotation force of the motor 95 to the valve shaft of the throttle valve 94. In greater detail, the crank 91 is a rosary element connected to the shaft of the motor 95, the crank 93 is a drive element connected to the shaft of the throttle valve 94, and the link 92 is a transmission element for transmitting a rotation force to the drive element 93.

The crank 91 is connected to the drive shaft of the motor 95 and the crank 93 is connected to the shaft of the throttle valve 94. The link 92 is then connected between the cranks 91 and 93. Although not shown in the figure, a return spring 21 is fixed to the shaft of the motor 95 and the casing as shown in FIG. 1B, and this return spring generates a counter-clockwise torque, as seen in these figures. The rotation angle of the motor 95 is restricted by a stopper 97 in the opening direction, and by a stopper 96 in the closing direction. The stopper 97 is set so that the throttle valve 94 stops at the fully opened position. On the other hand, the stopper 96 is placed at the default position of the throttle valve 94.

The operations in the throttle valve opening and closing apparatus of this embodiment will be explained. When the motor 95 generates a torque larger than that from the return spring 21, the crank 91 begins to rotate in a clockwise direction, and the crank 93 also is rotated via the link 92. In response to the rotation of the crank 93, the throttle valve 94 opens or closes. FIG. 6A shows a state in which the crank 91 is rotated clockwise by the maximum torque generated by the motor 95, and the throttle valve is fully open. In this state, if the torque of the motor 95 is decreased to a level smaller than that from the return spring 21, or the motor 95 is rotated in reverse, the crank 91 is also rotated counter-clockwise, until the throttle valve 94 is substantially fully closed. FIG. 6B shows the fully closed state of the throttle valve 94. The important point is that the shaft of the motor 95, the connection point of the crank 91 and the link 92, and the connection point of the link 92 and the crank 93, are in a row, in this state. Thus, even if the crank rotates in either a right or a left direction, the throttle valve 94 begins to open. When current flows in the motor 95, the cranks 91 and 93, and link 92, are operated in the above-mentioned range. If the power source of the motor 95 is turned off, the link 91 is further rotated counter-clockwise, and it knocks against the stopper 96 and stops at this point.

The valve opening characteristic of this embodiment is indicated by the curve 63 shown in FIG. 3. The rotation angle of the motor 95 at the default position is defined as 0 deg. The throttle valve 94 is gradually closed as the rotation angle of the motor 95 increases. When the crank 91 overlaps on the link 92, the throttle valve 94 is fully closed. After the fully closed position, the throttle valve 94 is opened to the fully open position.

The respective lengths of the cranks 91 and 93, and the link 92, are set so as to create the characteristics indicated by the curve 63 shown in FIG. 3. The most important point is that these lengths are set such that the crank 91 overlaps with the link 92 when the throttle valve 94 is fully closed. By this adjustment of these lengths, it becomes possible for the throttle valve 94 first to close and then to reopen again while the motor 95 rotates in one direction.

The above-mentioned setting of the respective lengths of the cranks 91 and 93, and the link 92, has the following advantage: because the fully closed position is the dead point of this link-crank mechanism, the speed reducing ratio is maximized, and a large torque is applied to the shaft of the throttle valve 94 by the motor 95 and the return spring 21, as indicated by the curves 88 and 91 of the diagram (E) shown in FIG. 5. Moreover, near the fully closed position, the gap between the throttle valve 94 and the inside wall of the air intake path is narrowed, and so sticking due to the presence of an external substance tends to occur. Therefore, it is advantageous to apply the maximum torque to the shaft of the throttle valve 94 near the fully closed position.

Furthermore, in this embodiment, by designing the lengths of the link 92 and the cranks 91 and 93 so as to create the characteristics indicated by the curve 63 in FIG. 3, the drive torque for the throttle valve is increased in the proximity to the fully open position, as shown by the curves 88 and 91 of the diagram (E) in FIG. 5. The above design of the link 92 and the cranks 91 and 93 has an advantage in that the torque to be generated by the motor 95 necessary for holding the valve in the fully open state can be reduced because of the larger drive torque of the throttle valve 14 obtained at the rotation angle of the motor 95 near the fully opened position.

In this embodiment, by using the return spring 21, the throttle valve 94 is closed and is pushed toward the default position. Although it is possible to hold the throttle valve 94 at the default position using only the return spring 21, it is designed so that the throttle valve 94 can be also returned to the default position using only the motor 95. Such an arrangement makes it possible to return the throttle valve 94 to the default position even if either the return spring 21 or the motor 95 becomes inoperable. That is, the valve closing means for the throttle valve 14 has a redundant function characteristic.

Furthermore, since the transmission mechanism is composed of the cranks 91 and 93 and the link 92, and the throttle valve 94 is opened from the default position to the open state via the almost fully closed state by rotating the crank 91 in one direction by substantially more than 180 deg., the operations from the fully closed position to the fully open position can be carried out by using a motor 95 of comparatively small torque generation. Accordingly, the throttle valve opening and closing apparatus can be downsized.

In the following, a third embodiment will be explained with reference to FIGS. 7A and 7B, and FIG. 8.

In this embodiment, in comparison with the second embodiment, it is intended that the production cost be reduced and the alignment accuracy and the durability of the throttle valve 94 both be improved by decreasing the backlash of the throttle valve 14.

As the drive means for driving the throttle valve 94 from the fully closed position to the fully open position, or vice versa, a motor 123, cranks 111 and 113, and a link 112 are used. The crank 111 is a rotary element connected to the shaft 110 of the motor 123, the crank 113 is a drive element connected to the shaft 124 of the throttle valve 94, and the link 112 is a transmission element for transmitting the drive force of the rotary element 111 to the drive element 113.

The cranks 111 and 113 are connected to the shaft 110 of the motor 123 and the shaft 124 of the throttle valve 94, respectively. Also, the cranks 111 and 113 are connected by the link 112. One terminal and the other terminal of a return spring 122 are fixed to a fixed pin 126 provided at the casing and a rotary pin 127 provided at a fan-shaped member 114 connected to the crank 111, respectively. The torque from the return spring 122 is generated in a clockwise direction as seen in FIGS. 7A and 7B. The rotation of the motor 123 is restricted by the stopper 116 and the stopper 115 in the respective opening and closing directions. The stopper 115 is provided at the rotation angle corresponding to the default position. Moreover, the stopper 116 is provided to prevent the throttle valve 94 from over-rotating beyond the fully opened position.

Figure 8:
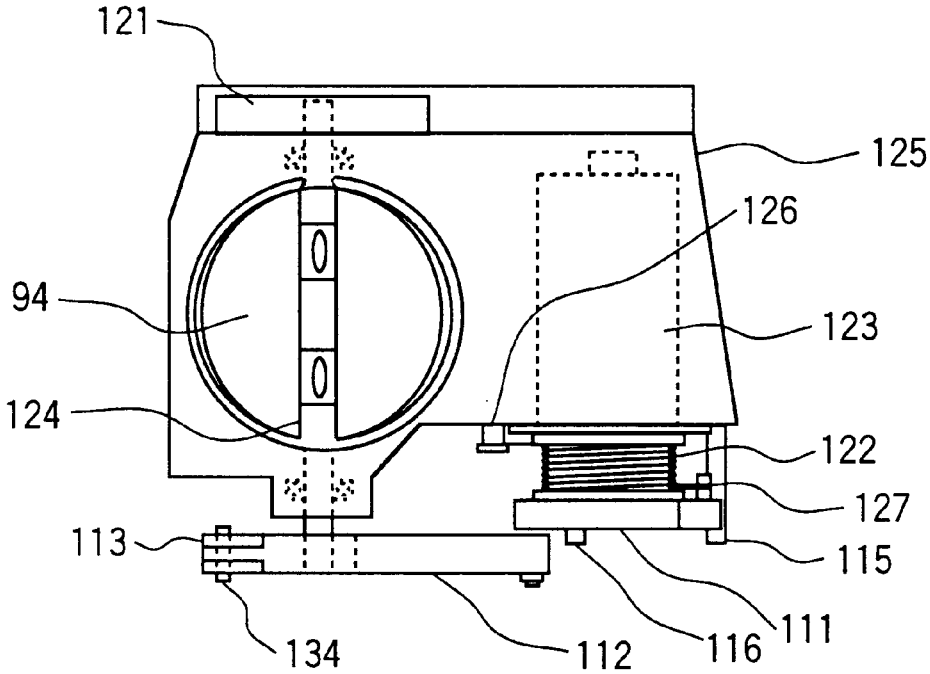
FIG. 8 is a plan view of the throttle valve opening and closing apparatus of the third embodiment.
Figure 9:
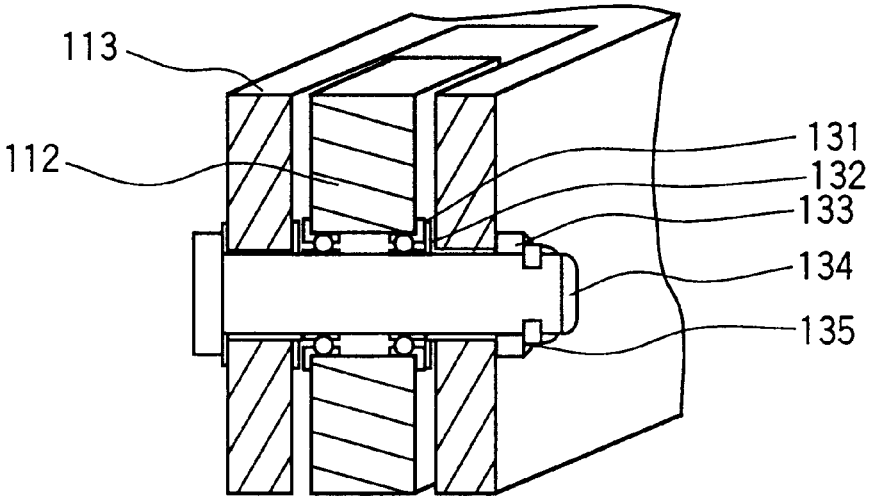
FIG. 9 is a sectional perspective view showing the connection part of a link and a crank in the throttle valve opening and closing apparatus of the third embodiment.

The link 112 is connected to the respective cranks 111 and 113 with pins. Moreover, the crank 113 and the link 112 are linked in the same plane as shown in FIG. 8 and FIG. 9. The pin connection of the crank 113 and the link 112 will now be explained with reference to FIG. 9. A slit groove is formed at the end part of the crank 113, and the link 112 is inserted in it. In the link 112, a penetration hole is provided, and bearings 132 are provided in the hole by a push-fitting method. A pin 134 passes through the penetration holes of the crank 113 and the link 112, and the bearings 132. Also, an E ring 135 is attached to the pin 134 to prevent a drop-out of the pin 134. For reducing backlash, a bush 133 is inserted between the crank 113 and the E ring 135.

By the above-mentioned link structure of the link 112 and the crank 113, the link 112 and the crank 113 can be arranged in the same plane. This arrangement has an advantage in that, since the link 112 and the crank 113 move in the same plane, the force towards the axis of the link pin 134 can be reduced, and backlash at the link pin 134 can be also decreased, which reduces the wear on the pin 134, thereby improving the durability of the throttle valve opening and closing apparatus.

The operations of the throttle valve opening and closing apparatus of this embodiment will be explained.

Figure 7A:
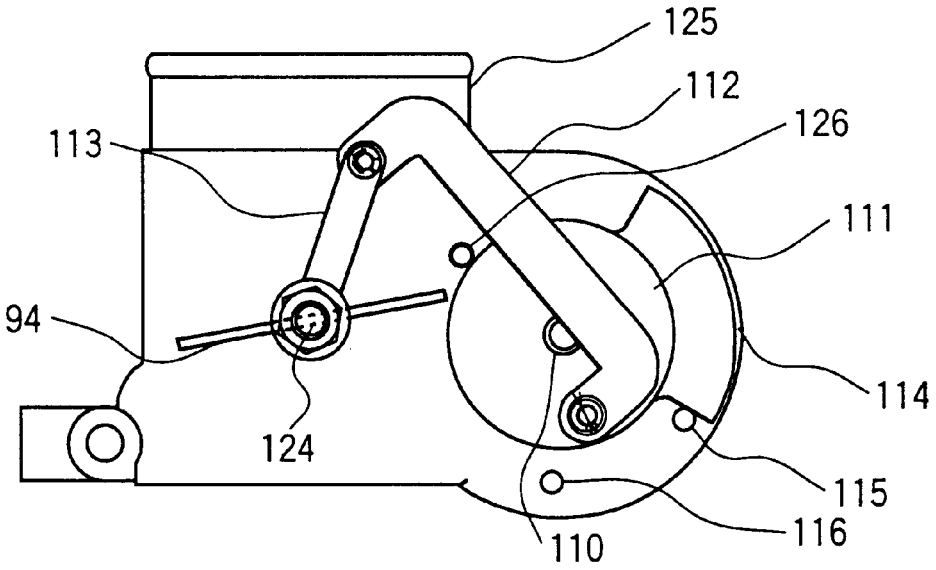
FIGS. 7A and 7B are sectional side elevations for explaining the composition and operation states of the throttle valve opening and closing apparatus representing a third embodiment according to the present invention.

As shown in FIG. 7A, if the motor 123 does not generate a torque, the fan-shaped member 114 is pushed to the stopper 115 by the force of the return spring 122, and the throttle valve 94 is held at the default position. When the torque generated by the motor 123 exceeds that from the return spring 122, the crank 111 rotates counter-clockwise, and the throttle valve 94 is driven in the closing direction. The throttle valve 94 operates in the closing direction until the center of the motor shaft 110, the center of the connection part of the crank 111 and the link 112, and the center of the connection part of the link 112 and the crank 113, are aligned in a row. If the motor 123 rotates further, the throttle valve is driven in the opening direction. In this embodiment also, the throttle valve 94 and the drive 31 mechanism are arranged so that the position the throttle valve is set at the fully closed position when the center of the motor shaft 110, the center of the connection part of the crank 111 and the link 112, and the center of the connection part of the link 112 and the crank 113, are aligned in a row. Now, the fully closed position is defined as a prescribed minimum opening position such that the throttle valve 94 is not likely to stick to the inner wall of the air intake path.

Figure 7B:
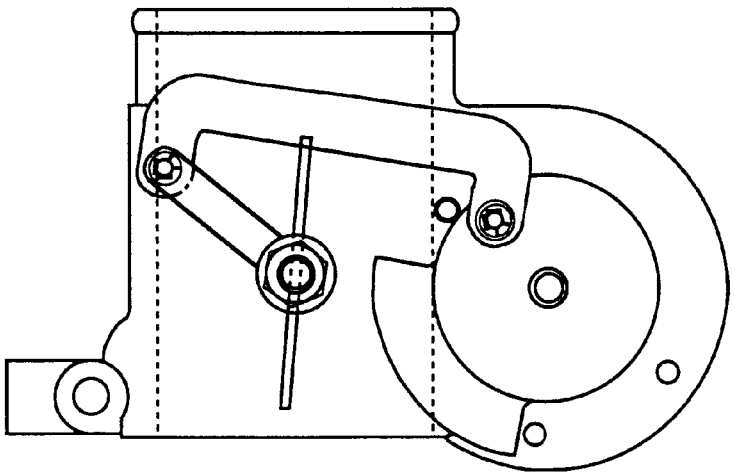

As shown in FIG. 7B, the motor 123 can continue to rotate in the opening direction of the throttle valve until the fan-shaped member 114 is stopped by the stopper 116.

If the torque of the motor 123 is reduced below that from the return spring 122, the throttle valve 94 is again returned to the initial state shown in FIG. 7A.

In this embodiment, the stoppers 115 and 116 interact with the fan-shaped member 114 connected to the crank 111. This is done so that repeated shocks to the link 112, the rotary pin 134, or the shaft 124 of the throttle valve 94, which would be generated if the stoppers 115 and 116 interact with these important elements, can be prevented. If shocks were allowed to act on these elements, it could possibly damage these elements, which would in turn degrade the alignment accuracy and the durability of the throttle valve 94. In the worst case, the throttle valve 94 could not then be opened or closed because of such damage. Thus, in this embodiment, since the generation of any shock originates from the motor 123 and the return spring 122, the stoppers 115 and 116 are arranged so that the generated shocks directly act on the shaft 110 of the motor 123. By realizing the above arrangement, it is possible to improve the durability and to prevent the deterioration in the alignment accuracy of the throttle valve 94.

In this embodiment also, by using the return spring 122, the throttle valve 94 is closed and is pushed toward the default position (initial position). Although it is possible to hold the throttle valve 94 at the default position using only the return spring 122, the apparatus of this embodiment is designed so that the throttle valve 94 can also be returned to the default position using the motor 123. This composition makes it possible to return the throttle valve 94 to the default position even if either of the return spring 122 or the motor 123 does not function. That is, the valve closing means for the throttle valve 94 is composed as a redundant system.

Furthermore, since the transmission mechanism is composed of the cranks 111 and 113 and the link 102, and the throttle valve 94 is opened from the default position to the open state via the closed state by rotating the crank 91 in one direction by more than 180 deg., the operations of the fully closed position to the fully open position can be carried out by using a motor 123 providing a comparatively small torque. Accordingly, the throttle valve opening and closing apparatus can be downsized.

Figure 10:
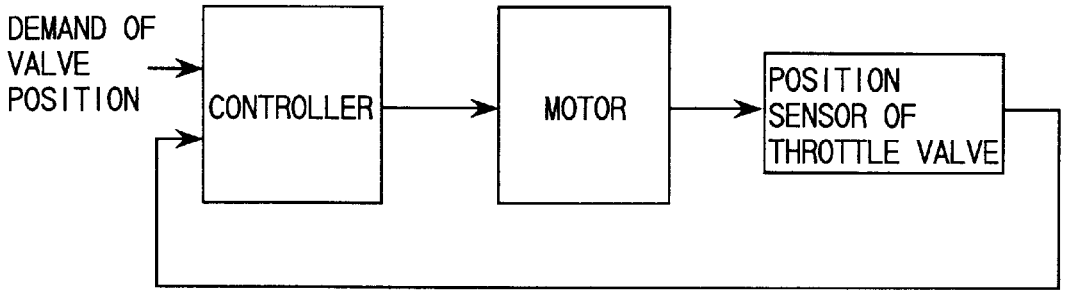
FIG. 10 is a schematic block diagram of a control system for the throttle valve opening and closing apparatus of the present invention.

FIG. 10 shows a control system for operating the throttle valve opening and closing apparatus in the above-described embodiment. The system includes a motor 152 used in the throttle valve opening and closing apparatus, a controller for controlling the drive force of the motor 152, and a valve position sensor 153 for sensing the position of the throttle valve 94. The valve position detected by the valve position sensor 153 is fed back to the controller 151. The controller 151 controls the drive force of the motor 152 by comparing the detected position and the command value for the valve position. In the controller, the relationship between the rotation angle of the motor 152 and the position of the throttle valve 94 is stored.

Figure 12:
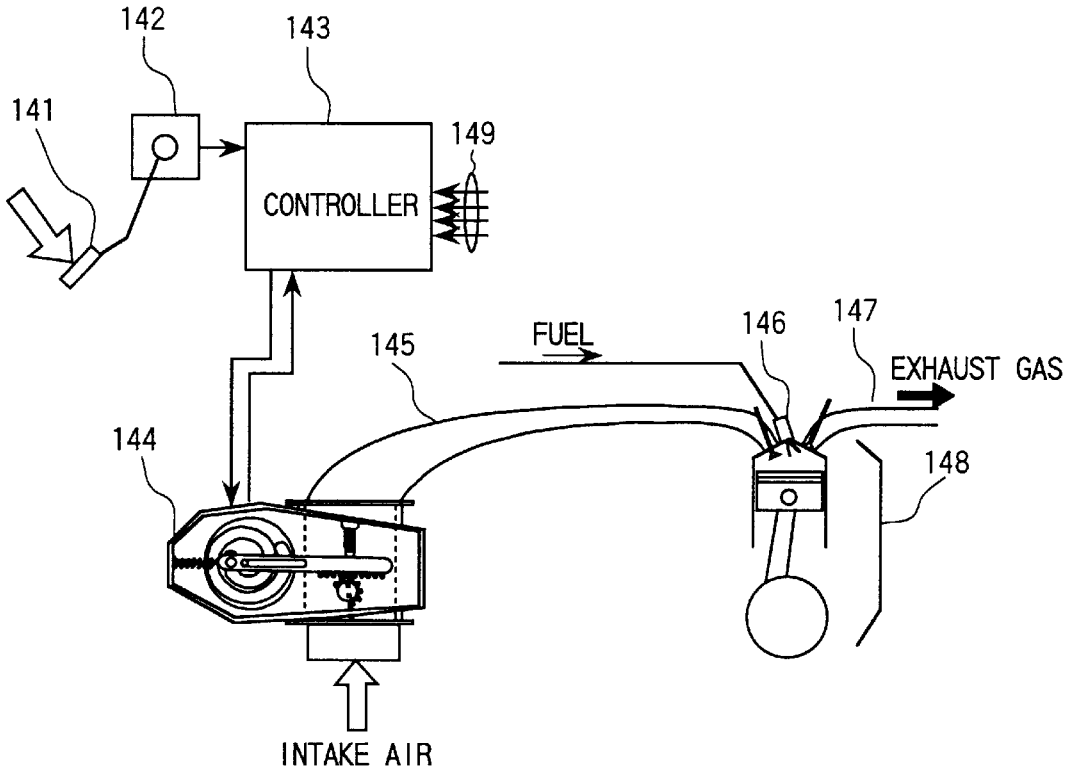
FIG. 12 is a diagram of the composition of a vehicle internal combustion engine using the throttle valve opening and closing apparatus of the first, second, or third embodiment.

FIG. 12 is a schematic diagram showing the composition of a vehicle internal combustion engine which has a throttle valve opening and closing apparatus according to the first embodiment, although the second or third embodiments may be employed as well. This engine comprises an acceleration pedal 141 which is operated by a driver, a position sensor 142 for detecting the position of the acceleration pedal 141, a controller 143 for controlling the position of the throttle valve so as to realize the optimal operation state of the engine based on the detected position of the position sensor 142, one of the throttle valve opening and closing apparatuses 144 according to the first, second and third embodiments, an air intake pipe 145 for taking air into the engine, an injector 146 for feeding fuel into the engine, an engine body 148, and a exhaust pipe 147 for expelling exhaust gas from the engine.

When the driver presses the acceleration pedal 141, the position sensor 142 detects the position of the acceleration pedal 141 and outputs the detected position to the controller 143. The controller 143 controls the throttle valve opening and closing apparatus 144 so as to realize the optimal operation state of the engine based on signals sent from various sensors 149.

Figure 13:
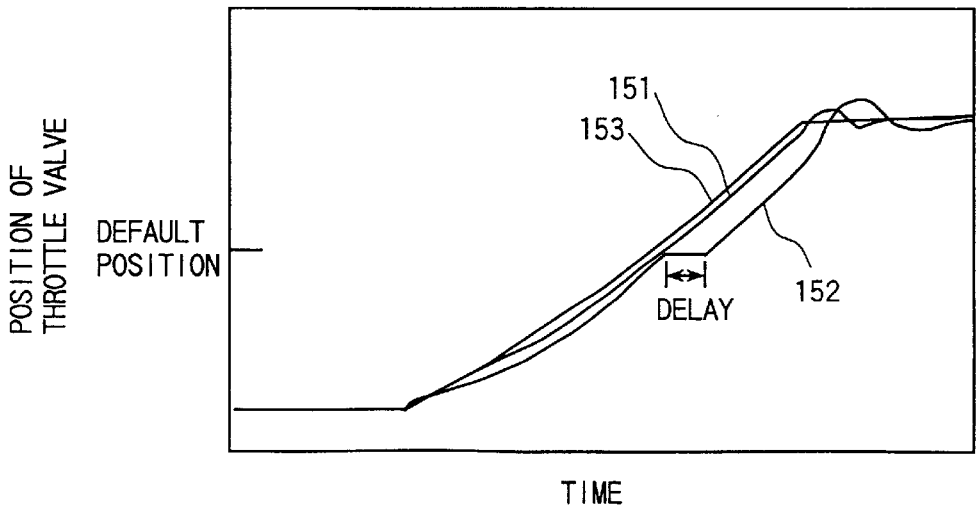
FIG. 13 is a graph which shows changes in time of the command value for the valve opening and the actual changes of the valve opening when a driver steps on an acceleration pedal.

The curve 153 shown in FIG. 13 shows an example of changes in time of the command value for the opening of the throttle valve 144 when a driver presses the acceleration pedal 141 in the idling state of the engine. Moreover, actual operations of the throttle valve are shown by the curve 151. It can be seen that the throttle valve is smoothly operated without a delay while following the changes of the command value. Thus, it is possible to increase the output power of the engine smoothly. On the other hand, if the engine is operated with a conventional throttle valve opening and closing apparatus, there occurs a delay at the default position, to the same changes of the command value as shown by the curve 152. This is because the direction of the torque of the spring applied to the motor is inverted at the default position. Since the throttle valve does not open smoothly, and the output power of the engine corresponds to the operations of the throttle valve, the engine can not be operated smoothly.

In accordance with the present invention, the drive means drives the throttle valve, which is held at the default initial opening position by the return spring, from the initial default opening position to the fully position via the prescribed minimum opening position in one direction. Therefore, even without the drive means, the throttle valve can be held at the default initial open state, and the mechanism for holding the initial open state can be simplified, and the throttle valve can be operated without a delay while smoothly following the command value for the valve opening.

What is claimed is:

1. A throttle valve opening and closing apparatus for opening and closing a throttle valve for adjusting the amount of intake air input into an internal combustion engine in a range from a fully open state to a fully closed state, including drive means for driving said throttle valve, and control means for controlling the opening degree of said throttle valve so as to follow a command value for the opening of said throttle valve, wherein said throttle valve is held at an initial state in which said throttle valve is open to a predetermined default opening degree when the drive force of said drive means does not act on said throttle valve, and said throttle valve is driven so as to first close to a prescribed minimal opening, and then to begin to open, when said throttle valve is driven from said initial state.

2. A throttle valve opening and closing apparatus according to claim 1, further including force applying means for applying force to said throttle valve in the direction of closing said throttle valve, so that said throttle valve is held at the state in which said throttle valve is opened to said predetermined default opening in the initial state when the drive force of said drive means does not act on said throttle valve.

3. A throttle valve opening and closing apparatus for opening and closing a throttle valve for adjusting the amount intake air input into an internal combustion engine in the range from a fully open state to a fully closed state, including drive means for driving said throttle valve, and control means for controlling the opening degree of said throttle valve so as to follow a command value for the opening of said throttle valve, wherein said drive means comprises valve opening change prescribing means and operation means for operating said valve opening change prescribing means, and said valve opening change prescribing means holds said throttle valve at an initial state in which said throttle valve is open to a predetermined default opening degree when the drive force of said operation means does not act on said valve opening change prescribing means, and drives said throttle valve so as to first close to a prescribed minimal opening and then to begin to open when said throttle valve is driven from said initial state.

4. A throttle valve opening and closing apparatus according to claim 3, further including force applying means for applying force to said throttle valve in the direction of closing said throttle valve so that a state of said throttle valve is held at the initial state in which said throttle valve is opened to said predetermined default opening in the initial state when the drive force of the drive means does not act on said throttle valve.

5. A throttle valve opening and closing apparatus according to claim 4, wherein said operation means in said drive means is a motor, and said valve opening change prescribing means changes the opening of said throttle valve from said predetermined default opening to the fully open position via said prescribed minimum opening while said motor rotates substantially by more than 180 deg.

6. A throttle valve opening and closing apparatus according to claim 5, in which a shaft of said motor is arranged parallel to a shaft of said throttle valve, and said valve opening change prescribing means comprises a rotary element connected to said shaft of said motor, a transmission element connected to said rotary element, and a valve drive element connected to said transmission element and to said shaft of said throttle valve; wherein a differential value, with respect to the rotation angle of said motor, of the distance between said shaft of said motor and the end of said transmission element on the side of said throttle valve, changes its sign once in the rotation range of said motor.

7. A throttle valve opening and closing apparatus according to claim 6, wherein the sign of said differential value changes at said prescribed minimum opening of said throttle valve.

8. A throttle valve opening and closing apparatus according to claim 6, in which said rotary element is a cam having a guide part for converting the rotation angle of said motor to the opening degree of said throttle valve, an arm having one terminal end engaged with said guide part and another terminal end connected to said shaft of said throttle valve, wherein a differential value, with respect to the rotation angle of said motor, of the distance between a rosary shaft of said cam and said guide part, is positive in one region and negative in the other region in the rotation range of said motor.

9. A throttle valve opening and closing apparatus according to claim 8, wherein one terminal end of said arm acting as said transmission element is coupled to said cam, and a rack structure is formed at the other terminal end of said arm, said rack structure being engaged with a gear provided on said shaft of said throttle valve.

10. A throttle valve opening and closing apparatus according to claim 8, wherein said guide part is shaped as a spiral groove.

11. A throttle valve opening and closing apparatus according to claim 10, wherein the shape of said spiral groove is involute.

12. A throttle valve opening and closing apparatus according to claim 6, wherein said rotary element, said valve drive element, and said transmission element are a crank driven by said motor, a crank for rotating said shaft of said throttle valve, and a link connected between said two cranks, respectively, and said force applying means is a spring for applying force to a shaft of said crank driven by said motor, in one direction.

13. A throttle valve opening and closing apparatus according to claim 12, wherein the connection point of said shaft of said motor and said crank acting as said rotary element, the connection point of said crank acting as said rotary element and said link, and the connection point of said link and said crank acting as said valve drive element, are aligned a row, at said prescribed minimum opening of said throttle valve.

14. A vehicle internal combustion engine comprising:

a plurality of cylinders, a fuel system for feeding fuel into each of said plurality of said cylinders, a throttle valve for adjusting the amount of intake air input into the cylinders of said internal combustion engine, and a throttle valve opening and closing apparatus for opening and closing said throttle valve in a range from a fully open state to a fully closed state, including drive means for driving said throttle valve, and control means for controlling the opening degree of said throttle valve so as to follow command values for the opening of said throttle valve, wherein said drive means comprises valve opening change prescribing means and operation means for operating the valve opening change prescribing means, and said valve opening change prescribing means holds a state of said throttle valve at an initial state in which said throttle valve is opened to a predetermined default opening degree when the drive force of said operation means does not act on said valve opening change prescribing means, and for driving said throttle valve so as to first close to a prescribed minimum opening and then begin to open when said throttle valve is driven from said initial state.

* * * * *